US009578905B1

(12) United States Patent
Sloan

(10) Patent No.: US 9,578,905 B1
(45) Date of Patent: Feb. 28, 2017

(54) VENTILATED MEDICAL LEG GARMENT

(71) Applicant: Sloan Corporation, Omaha, NE (US)

(72) Inventor: Stewart Sloan, Omaha, NE (US)

(73) Assignee: SLOAN CORPORATION, Omaha, NE (US)

( * ) Notice: Subject to any disclaimer, the term of this patent is extended or adjusted under 35 U.S.C. 154(b) by 261 days.

(21) Appl. No.: 14/626,309

(22) Filed: Feb. 19, 2015

Related U.S. Application Data

(63) Continuation of application No. 14/619,937, filed on Feb. 11, 2015, now abandoned.

(60) Provisional application No. 62/063,193, filed on Oct. 13, 2014.

(51) Int. Cl.

| | |
|---|---|
| ***A41D 13/00*** | (2006.01) |
| ***A41D 13/002*** | (2006.01) |
| ***A41D 13/05*** | (2006.01) |
| ***A41D 13/12*** | (2006.01) |

(52) U.S. Cl.
CPC ..... *A41D 13/002* (2013.01); *A41D 13/0543* (2013.01); *A41D 13/12* (2013.01)

(58) Field of Classification Search
CPC ..... A41D 13/12; A41D 13/1209; A41D 13/1227; A41D 13/1254; A41D 13/1236; A41D 13/1263
See application file for complete search history.

(56) References Cited

U.S. PATENT DOCUMENTS

| | | | | |
|---|---|---|---|---|
| 1,679,102 | A | 7/1928 | Thompson | |
| 2,079,980 | A | 5/1937 | Anders | |
| 2,391,535 | A | 12/1945 | Zelano | |
| 4,513,451 | A | 4/1985 | Brown | |
| 4,608,715 | A | 9/1986 | Miller | |
| 4,914,752 | A | 4/1990 | Hinson | |
| 5,704,064 | A * | 1/1998 | van der Sleesen .... | A41D 27/28 2/108 |
| 2011/0302703 | A1* | 12/2011 | Silverberg ..... | A41D 13/1209 2/457 |
| 2016/0135517 | A1* | 5/2016 | Silverberg ..... | A41D 13/1209 2/93 |

FOREIGN PATENT DOCUMENTS

| | | |
|---|---|---|
| CN | 2645472 | 10/2004 |
| CN | 201683112 | 12/2010 |
| CN | 203328045 | 12/2013 |

* cited by examiner

*Primary Examiner* — Shaun R Hurley
*Assistant Examiner* — Andrew W Sutton
(74) *Attorney, Agent, or Firm* — Hovey Williams LLP

(57) ABSTRACT

A ventilated medical leg garment comprises a foot covering, a leg covering, a lower elastic band, an upper elastic band, and a ventilation assembly. The foot covering and the leg covering cooperatively form an open-topped interior chamber for receiving a wearer's foot and lower leg therein. The ventilation assembly includes a ventilation patch, a screen mesh, and a hood. The ventilation patch is positioned over an orifice of the leg covering and includes a ventilation opening for allowing air to pass therethrough. The screen mesh extends across the ventilation opening for keeping the ventilation opening unobstructed. The hood extends over and past the ventilation opening for directing fluids and debris past and away from the ventilation opening.

20 Claims, 4 Drawing Sheets

VENTILATED MEDICAL LEG GARMENT

RELATED APPLICATIONS

The present application is a continuation patent application and claims priority benefit, with regard to all common subject matter, of earlier-filed U.S. non-provisional patent application titled "VENTILATED MEDICAL LEG GARMENT," Ser. No. 14/619,937, filed Feb. 11, 2015, incorporated by reference in its entirety into the present application. The earlier-filed U.S. non-provisional patent application in turn claims priority benefit, with regard to all common subject matter, of earlier-filed U.S. provisional patent application titled "IMPERMEABLE MEDICAL GARMENTS WITH VENTILATION", Ser. No. 62/063,193, filed on Oct. 13, 2014, incorporated by reference in its entirety into the present application.

BACKGROUND

Nurses, doctors, surgeons, and other medical personnel often wear medical leg garments over their scrubs or other clothing for providing protection from bodily fluids and airborne contaminants, pathogens, and debris. Medical leg garments are typically made of impermeable material to prevent these substances from contacting the medical personnel's clothing or skin. Unfortunately, these medical leg garments are uncomfortable because the impermeable material traps warm air inside and prevents cooler air from replacing the warm air. Some medical leg garments include ventilation openings for allowing air to flow into and out of the garments, but these openings allow bodily fluids and airborne contaminants, pathogens, and debris to enter. These openings are also often positioned on areas of the garments that do not promote air flow through the openings.

SUMMARY

The present invention solves the above-described problems and provides a distinct advance in the art of medical leg garments. More particularly, the present invention provides a medical leg garment that vents air from within the medical leg garment while preventing bodily fluids and airborne contaminants, pathogens, and debris from entering the medical leg garment.

An embodiment of the medical leg garment broadly comprises a foot covering, a leg covering, a lower elastic band, an upper elastic band, and a ventilation assembly.

The foot covering and leg covering are formed of lightweight impermeable material and cooperatively form an open-topped interior chamber for receiving the wearer's foot and leg therein.

The lower elastic band secures the ventilated medical leg garment against the ankle and prevents the foot covering from becoming misaligned on the wearer's foot. The upper elastic band secures the top of the leg covering against the wearer's leg and prevents air from entering the top of the ventilated medical leg garment.

The leg covering includes an orifice positioned between approximately 0.5 inches to 8 inches below the upper elastic band on the front, back, left side, or right side of the leg covering for providing air flow into and out of the interior chamber.

The ventilation assembly vents air in and out of the orifice while preventing contaminants from entering the leg covering through the orifice. An embodiment of the ventilation assembly includes a ventilation patch, a screen mesh, and a hood.

The ventilation patch is positioned over the orifice and includes a ventilation opening for allowing air to flow into and out of the orifice. The ventilation patch may be square, rectangular, triangular, circular, or any other suitable shape and may be hermetically heat sealed, glued, or stitched to the leg covering.

The screen mesh extends across the ventilation opening for keeping the ventilation opening unobstructed and preventing the ventilation patch from folding over on itself and closing off the opening. The screen mesh may be square, rectangular, triangular, circular, or any other suitable shape and includes a number of small holes or openings for allowing air to pass therethrough.

The hood extends over the ventilation patch and the ventilation opening and directs bodily fluids and airborne contaminants, pathogens, and debris past and away from the ventilation opening. The hood may be square, rectangular, triangular, or any other suitable shape. In some embodiments, the hood may be attached to the ventilation patch or leg covering on its top and side edges and unattached on its bottom edge for allowing air to flow upwards into the ventilation opening and downwards upon exiting the ventilation opening.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
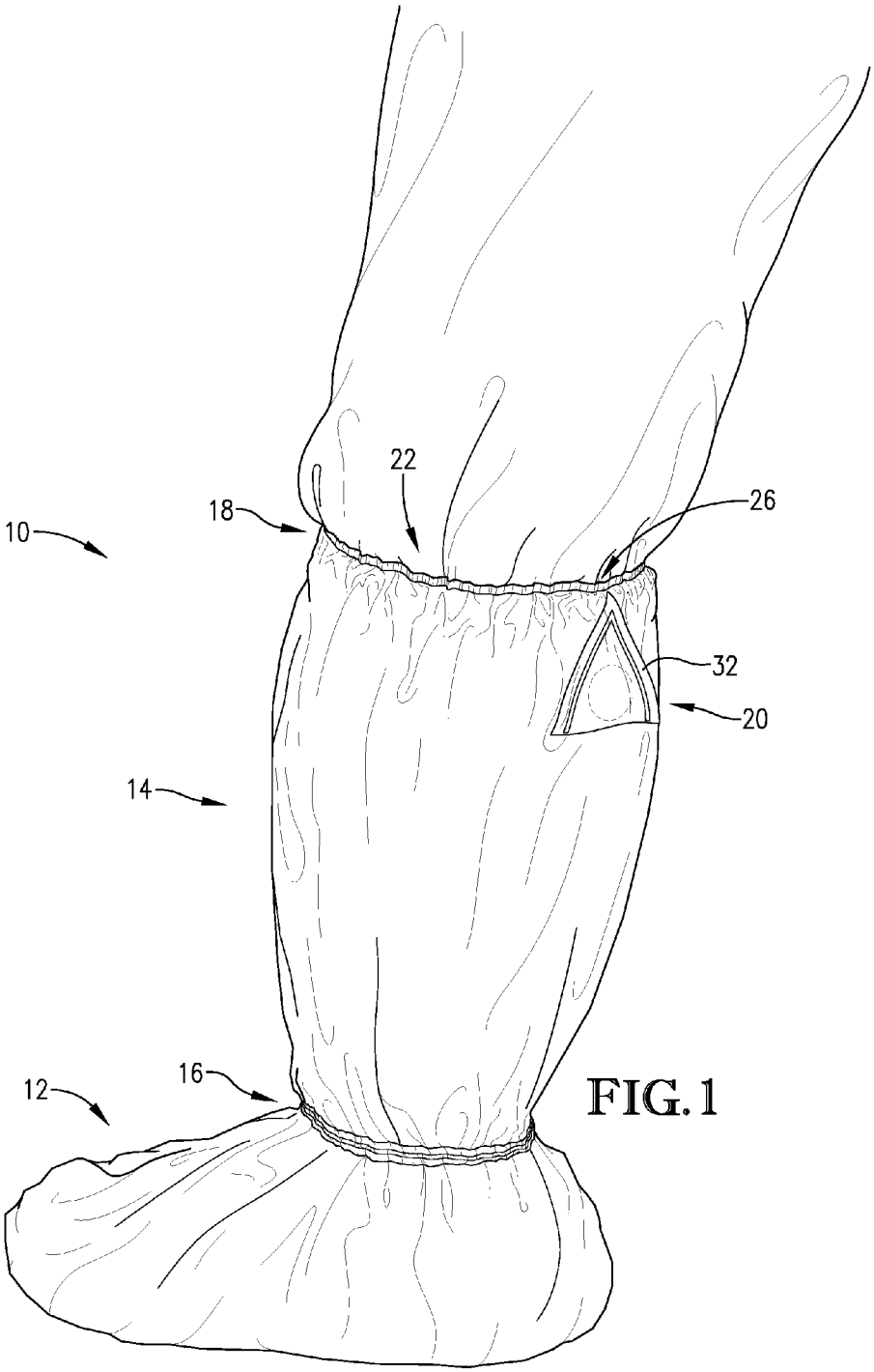
FIG. 1 is a perspective view of a ventilated medical leg garment constructed in accordance with an embodiment of the present invention and shown on a wearer's leg.
Figure 2:
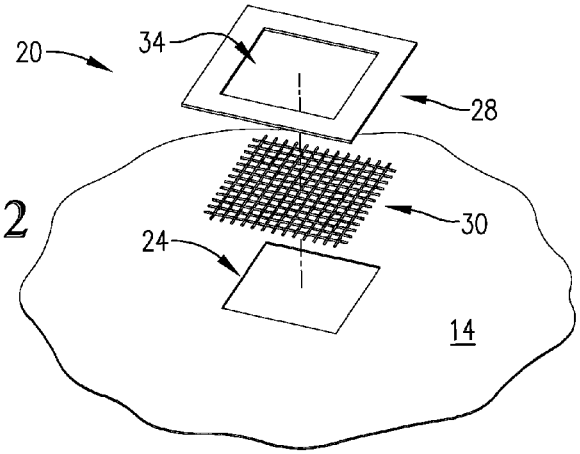
FIG. 2 is a partial assembly view of an embodiment of the ventilation assembly of FIG. 1.
Figure 3:
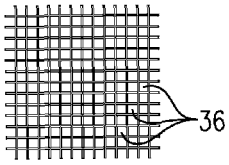
FIG. 3 is an enlarged elevation view of a square shaped screen mesh.
Figure 4:
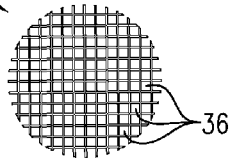
FIG. 4 is an enlarged elevation view of a circular shaped screen mesh.
Figure 5:
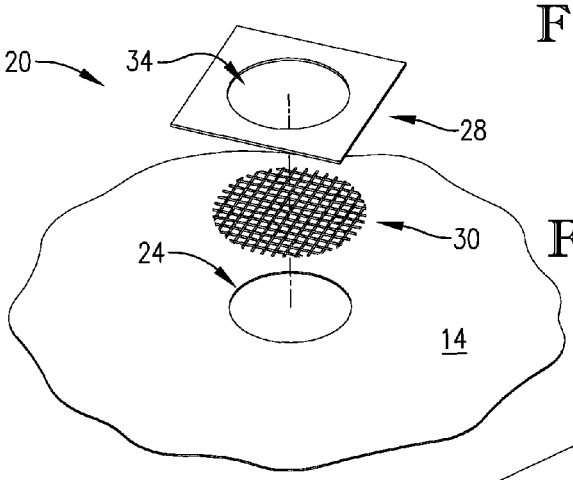
FIG. 5 is a partial assembly view of another embodiment of the ventilation assembly of FIG. 1.
Figure 6:
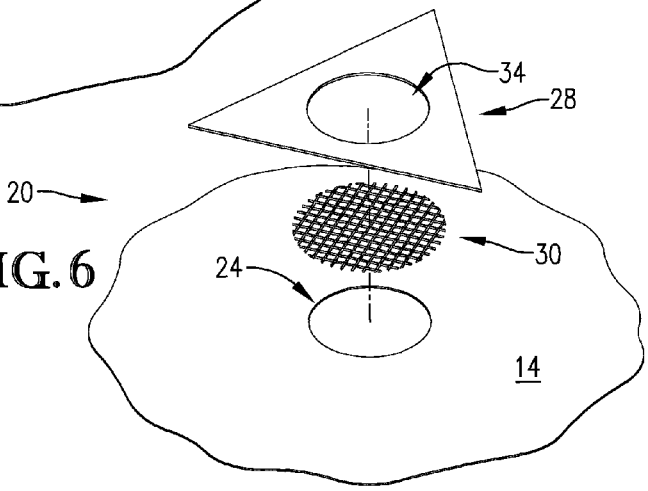
FIG. 6 is a partial assembly view of another embodiment of the ventilation assembly of FIG. 1.

The drawing figures do not limit the present invention to the specific embodiments disclosed and described herein.

The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, and particularly FIGS. 1-6, a ventilated medical leg garment 10 constructed in accordance with an embodiment of the invention is illustrated. The ventilated medical leg garment 10 broadly comprises a foot covering 12, a leg covering 14, a lower elastic band 16, an upper elastic band 18, and a ventilation assembly 20.

The foot covering 12 covers a wearer's foot and shoe and may be formed of impermeable plastic, rubber, nylon, polyethylene, or any other suitable material. The foot covering 12 may be shaped specifically for a left foot or a right foot or may be shaped to receive either foot.

The leg covering 14 extends upward from the top of the foot covering 12 to the lower part of the wearer's knee and covers the wearer's ankle and lower leg. The leg covering 14 may also extend up to the top of the wearer's knee or to the wearer's groin for covering the wearer's knee and/or upper leg. The leg covering 14 may be formed of impermeable plastic, rubber, nylon, polyethylene, or any other suitable material and may be integrally formed with the foot covering 12 or may be formed of a separate piece of material hermetically heat sealed or stitched to the top of the foot covering 12. The leg covering 14 includes an upper opening 22 for receiving the wearer's foot and leg in the ventilated medical leg garment 10 and an orifice 24 for allowing air to flow into and out of the ventilated medical leg garment 10. The orifice 24 may be approximately 0.5 inches to 3 inches wide and approximately 0.5 inches to 3 inches tall and may be square, rectangular, triangular, circular, or any other suitable shape. The orifice 24 may be positioned between approximately 0.5 inches to 8 inches below the upper elastic band 18 near the front, back, outer side (e.g., the right side of a right leg garment 10), or inner side of the leg covering 14.

The lower elastic band 16 extends between the leg covering 14 and the foot covering 12 and contracts around the wearer's ankle for ensuring that the foot covering 12 remains oriented properly on the wearer's foot without bunching up or becoming misaligned from the wearer's foot. The lower elastic band 16 may be a stretchable rubber band integrated into the ventilated medical leg garment 10, a stretchable stitching pattern, a combination of stretchable rubber and stitching, or any other suitable stretchable material.

The foot covering 12 and the leg covering 14 cooperatively form an open-topped interior chamber 26 for receiving the wearer's foot therein. The open-topped interior chamber 26 extends to the upper opening 22 of the leg covering 14 and may be large enough to comfortably receive one or more layers of clothing such as jeans and/or medical scrubs therein with additional buffer space for sufficient air circulation around the wearer's clothes within the open-topped interior chamber 26.

The upper elastic band 18 ensures that the leg covering 14 does not fall to the wearer's ankle and prevents bodily fluids and airborne contaminants, pathogens, and debris from entering the open-topped interior chamber 26. The upper elastic band 18 extends around the upper opening 22 of the leg covering 14 and may be a rubber band integrated into the ventilated medical leg garment 10, a stretchable stitching pattern that tends to tighten the top edge of the leg covering 14, a combination of stretchable rubber and stitching, or any other suitable stretchable material.

The ventilation assembly 20 vents air in and out of the orifice 24 while preventing contaminants from entering the leg covering through the orifice 24. The ventilation assembly 20 may be positioned over the orifice 24 between approximately 0.5 inches to 8 inches below the upper elastic band 18 near the front, back, outer side (e.g., the right side of a right leg garment 10), or inner side of the leg covering 14. An embodiment of the ventilation assembly 20 includes a ventilation patch 28, a screen mesh 30, and a hood 32.

Figure 7:
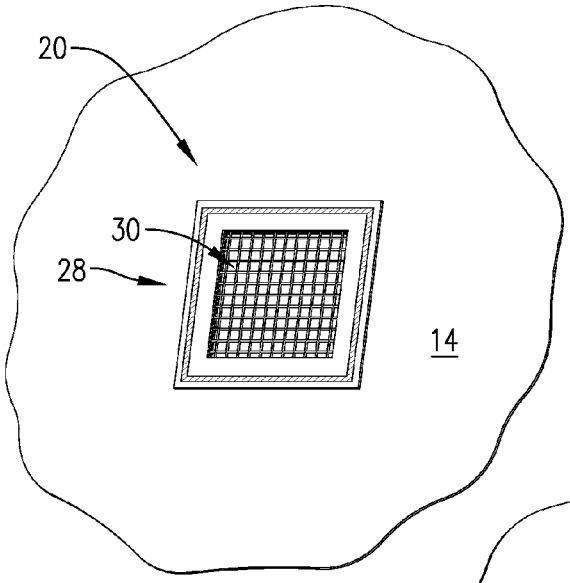
FIG. 7 is an enlarged partial interior perspective view of another embodiment of the ventilation assembly of FIG. 1.
Figure 8:
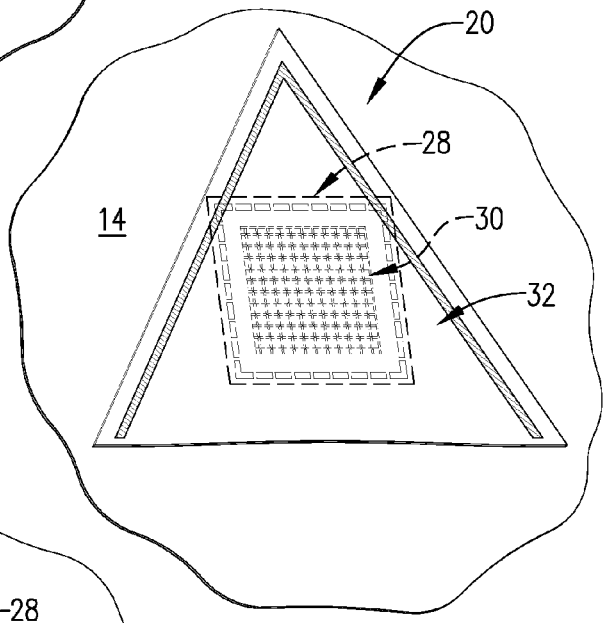
FIG. 8 is an enlarged partial perspective view of another embodiment of the ventilation assembly of FIG. 1.
Figure 9:
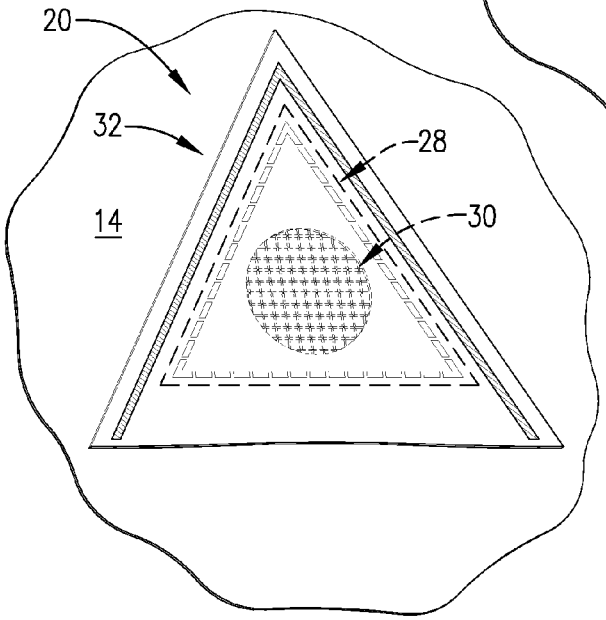
FIG. 9 is an enlarged partial perspective view of another embodiment of the ventilation assembly of FIG. 1.

The ventilation patch 28 strengthens the area around the screen mesh 30 and may be formed of impermeable plastic, rubber, nylon, polyethylene, reinforced material, or any other suitable material. The ventilation patch 28 may be shaped to fit the shape of the orifice 24 of the leg covering 14 (FIG. 4) and may be hermetically heat sealed, glued, or stitched to the leg covering 14 (FIGS. 7-9). The ventilation patch 28 includes a ventilation opening 34 for allowing air to flow in and out of the interior chamber 26. The ventilation opening 34 may be square or rectangular (FIG. 4), circular (FIGS. 5 and 6), triangular, a slit or narrow opening, or any other suitable shape. In one embodiment, the ventilation opening 34 is circular with a diameter of approximately 1.5 inches. The ventilation opening 34 may be positioned between 0.5 inches to 8 inches below the upper elastic band 18 so that the ventilation opening 34 is located on an area of the leg covering 14 that tends to billow outwards away from the wearer's clothing.

The screen mesh 30 extends over the ventilation opening 34 for keeping the ventilation opening 34 unobstructed and preventing the ventilation patch 32 from folding over on itself and closing off the ventilation opening 34. The screen mesh 30 may be formed of plastic, rubber, nylon, polyethylene, thin wires or filaments, or other suitable material, as shown in FIGS. 2-9. The screen mesh 30 forms a number of small holes 36 and may have an orthogonal pattern oriented horizontally and vertically or oriented at an angle. Alternatively, the screen mesh 30 may have a staggered pattern, a random pattern, or any other suitable pattern. The screen mesh 30 may be hermetically heat sealed, glued, or stitched to the ventilation patch 28 around the ventilation opening 34. The screen mesh 30 may also be angled in relation to the ventilation patch 28 to increase the bond strength between the screen mesh 30 and the ventilation patch 28.

The hood 32 directs bodily fluids and debris away from the ventilation opening 34 and extends over the ventilation opening 34, as shown in FIGS. 8 and 9. The hood 32 may be formed of impermeable plastic, rubber, nylon, polyethylene, or any other suitable material and may be square, rectangular, triangular, or any other suitable shape. The hood 32 may have a length of between 0.5 inches to 5 inches and a width of between 0.5 inches to 5 inches and may be hermetically heat sealed, glued, or stitched to the ventilation patch 28 or the leg covering 14 at its top edge and side edges with its bottom edge being unattached. In one embodiment, the hood 32 may have an isosceles triangular shape with upper edges of the triangle each having a length of 3 inches. The hood 32 may also have additional material and may have pleats or similar features for ensuring that the hood 32 allows air to enter and exit the ventilation opening 34. In one embodiment, the hood 32 extends approximately 1 inch below the bottom of the ventilation opening 34 for ensuring that fluids and debris do not enter the ventilation opening 34.

It will be understood that the ventilated medical leg garment 10 may be one of a pair of ventilation medical leg garments. The ventilated medical leg garments may be interchangeably worn on the left or right foot or may be mirrored versions of each other and shaped or designated for being worn on a specific foot. For example, the foot covering 12 of one of the ventilated medical leg garments may be shaped for receiving the right foot and the ventilation assembly 20 may be positioned on the outside (e.g., the right side of the right leg) for improving air flow into and out of the ventilation opening 34. Alternatively, the ventilated medical leg garment may have a ventilation assembly 20 on both the inside and the outside of the leg covering 14 or a ventilation assembly 20 positioned at a neutral location such as the front of the leg covering 14 for being worn on either foot.

The above-described ventilated medical leg garment 10 provides several advantages over conventional medical leg garments. For example, the ventilation patch 28 of the ventilation assembly 20 strengthens the area around the ventilation opening 34. The different shape of the ventilation patch 28 compared to the ventilation opening 34 further increases strength around the ventilation opening 34. The ventilation assembly 20 is also positioned between 0.5 inches to 8 inches below the upper elastic band 18, which encourages air to flow into and out of the interior chamber 26. The hood 32 directs fluids and debris away from and below the ventilation opening 34 so that they do not enter the ventilation opening 34. The screen mesh 30 prevents the ventilation patch 32 from folding over on itself and closing off the ventilation opening 34.

Figure 10:
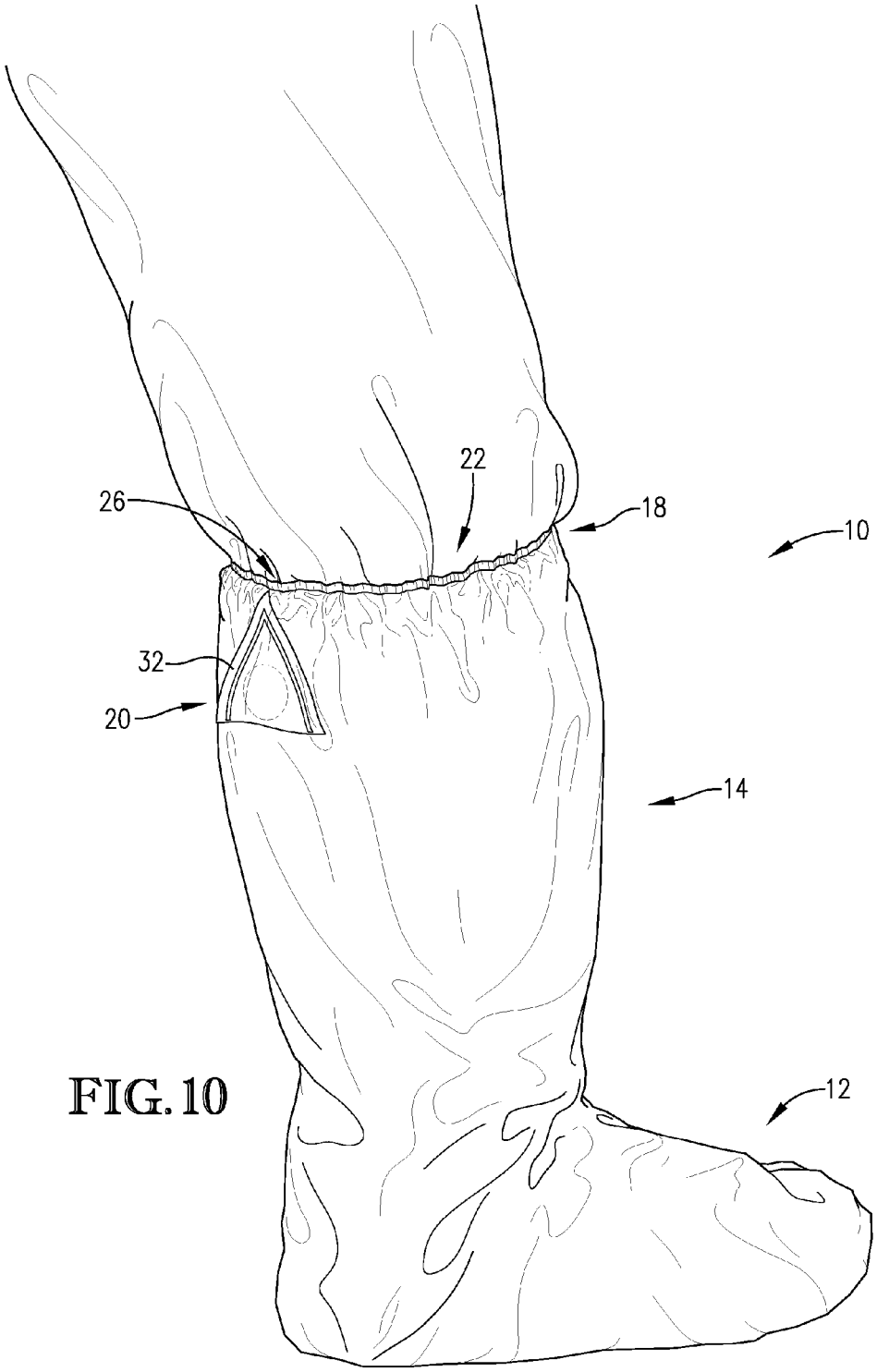
FIG. 10 is a perspective view of a ventilated medical leg garment constructed in accordance with another embodiment of the present invention and shown on a wearer's leg.

Another embodiment of the present invention is substantially similar to the above-described ventilated medical leg garment 10 except the foot covering 12 and leg covering 14 do not have a lower elastic band therebetween, as shown in FIG. 10. The foot covering 12 and the leg covering 14 may be formed of a unitary piece of material substantially boot-shaped for receiving the wearer's foot and lower leg in the interior chamber 26. This simplifies inserting the wearer's foot into, and removing the wearer's foot from, the interior chamber 26 and improves air circulation within the interior chamber 26.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A ventilated medical leg garment comprising:

a foot covering;

a leg covering integrally formed with and extending upward from the foot covering, the foot covering and the leg covering cooperatively forming an interior chamber configured to receive a wearer's foot and lower leg therein, the leg covering including:

an upper opening configured to allow the wearer to insert his foot and lower leg into the interior chamber; and an orifice positioned between 0.5 inches to 3 inches below the upper opening;

an elastic band extending around the upper opening configured to at least partially enclose the leg covering around the wearer's lower leg; and a ventilation assembly for venting air in and out of the orifice while preventing contaminants from entering the leg covering through the orifice, the ventilation assembly comprising:

a ventilation patch positioned in the orifice of the leg covering and attached to the leg covering via hermetic heat sealing, the ventilation patch having an upward-pointing triangular shape and including a circular ventilation opening having a diameter of between 1 inch and 2 inches and positioned near the center of the triangular shape for allowing air to flow therethrough;

a screen mesh extending over the ventilation opening of the ventilation patch and attached to the ventilation patch via hermetic heat sealing for keeping the ventilation opening unobstructed and preventing the ventilation patch from folding over on itself and closing off the ventilation opening; and a hood attached to the leg covering via hermetic heat sealing along upper edges of the hood and unattached to the leg covering along a bottom edge of the hood for allowing air to flow through the ventilation opening from below the hood, the hood extending below the bottom edge of the triangular ventilation patch for directing bodily fluids and other liquids downward past the ventilation opening.

2. The ventilated medical leg garment of claim 1, wherein the hood is triangular shaped and includes an additional amount of material such that the triangular shaped hood tends to be at least partially spaced from the leg covering for allowing air to flow to the ventilation opening.

3. The ventilated medical leg garment of claim 2, wherein the triangular shaped hood includes a number of pleats for allowing air to flow to the ventilation opening.

4. The ventilated medical leg garment of claim 2, wherein each edge of the triangular shaped hood is at least 3 inches long.

5. The ventilated medical leg garment of claim 2, wherein each edge of the ventilation patch is at least 2 inches long.

6. The ventilated medical leg garment of claim 2, wherein the foot covering, the leg covering, the ventilation patch, and the triangular shaped hood are formed of polyethylene.

7. A ventilated medical leg garment comprising:

a foot covering;

a leg covering integrally formed with and extending upward from the foot covering, the foot covering and the leg covering cooperatively forming an open-topped chamber configured to receive a wearer's foot and lower leg therein, the leg covering including:

an upper opening configured to allow the wearer to insert his foot and lower leg into the interior chamber; and an orifice positioned between 0.5 inches to 3 inches below the upper opening;

an elastic band extending around the upper opening configured to at least partially enclose the leg covering around the wearer's lower leg; and a ventilation assembly for venting air in and out of the orifice while preventing contaminants from entering the leg covering through the orifice, the ventilation assembly comprising:

a ventilation patch positioned in the orifice of the leg covering and attached to the leg covering via hermetic heat sealing, the ventilation patch having a rectangular shape and including a rectangular ventilation opening having a width of between 0.5 inches and 2 inches and a height of between 2 inches and 3 inches and positioned near the center of the rectangular shape for allowing air to flow therethrough;

a screen mesh extending over the ventilation opening of the ventilation patch and attached to the ventilation patch via hermetic heat sealing for keeping the ventilation opening unobstructed and preventing the ventilation patch from folding over on itself and closing off the ventilation opening; and a triangular shaped hood attached to the leg covering via hermetic heat sealing over the rectangular ventilation patch and unattached to the leg covering below the rectangular ventilation patch for allowing air to flow through the ventilation opening from below the triangular shaped hood, the triangular shaped hood extending below the bottom edge of the rectangular ventilation patch for directing bodily fluids and other liquids downward past the ventilation opening.

8. The ventilated medical leg garment of claim 7, wherein the screen mesh includes an orthogonal pattern.

9. The ventilated medical leg garment of claim 8, wherein the orthogonal pattern of the screen mesh is aligned with the rectangular shape of the ventilation patch.

10. The ventilated medical leg garment of claim 7, wherein the triangular shaped hood includes an additional amount of material such that the hood tends to be at least partially spaced from the leg covering for allowing air to flow to the opening.

11. The ventilated medical leg garment of claim 7, wherein the triangular shaped hood forms an isosceles triangle.

12. The ventilated medical leg garment of claim 7, wherein each edge of the triangular shaped hood is at least 3 inches long.

13. The ventilated medical leg garment of claim 7, wherein each edge of the triangular ventilation patch is at least 2 inches long.

14. A ventilated medical leg garment comprising:

a foot covering;

a leg covering integrally formed with and extending upward from the foot covering, the foot covering and the leg covering cooperatively forming an interior chamber configured to receive a wearer's foot and lower leg therein, the leg covering including:

an upper opening configured to allow the wearer to insert his foot and lower leg into the interior chamber; and an orifice positioned between 0.5 inches to 3 inches below the upper opening;

an elastic band extending around the upper opening configured to at least partially enclose the leg covering around the wearer's lower leg; and a ventilation assembly for venting air in and out of the orifice while preventing contaminants from entering the leg covering through the orifice, the ventilation assembly comprising:

a ventilation patch positioned in the orifice of the leg covering and attached to the leg covering via hermetic heat sealing, the ventilation patch having a rectangular shape and including a circular ventilation opening having a diameter of between 1 inch and 2 inches and positioned near the center of the rectangular shape for allowing air to flow therethrough;

a screen mesh extending over the ventilation opening of the ventilation patch and attached to the ventilation patch via hermetic heat sealing for limiting an amount of air flowing through the ventilation opening and for keeping the ventilation opening unobstructed and preventing the ventilation patch from folding over on itself and closing off the ventilation opening; and a triangular shaped hood attached to the leg covering via hermetic heat sealing over the rectangular ventilation patch and unattached to the leg covering below the rectangular ventilation patch for allowing air to flow through the ventilation opening from below the triangular shaped hood, the triangular shaped hood extending below the bottom edge of the rectangular ventilation patch for directing bodily fluids and other liquids downward past the opening.

15. The ventilated medical leg garment of claim 14, wherein the screen mesh includes an orthogonal pattern.

16. The ventilated medical leg garment of claim 15, wherein the orthogonal pattern of the screen mesh is aligned with the rectangular shape of the ventilation patch.

17. The ventilated medical leg garment of claim 14, wherein the hood includes an additional amount of material such that the hood tends to be at least partially spaced from the leg covering for allowing air to flow to the ventilation opening.

18. The ventilated medical leg garment of claim 14, wherein the triangular shaped hood forms an isosceles triangle.

19. The ventilated medical leg garment of claim 14, wherein each edge of the triangular shaped hood is at least 3 inches long.

20. The ventilated medical leg garment of claim 14, wherein each edge of the triangular ventilation patch is at least 2 inches long.

* * * * *